US007198270B1

(12) United States Patent
Bishop

(10) Patent No.: US 7,198,270 B1
(45) Date of Patent: Apr. 3, 2007

(54) KINEMATICALLY COMPATIBLE PARALLELPIPEDAL CELLS

(76) Inventor: Forrest Frederick Bishop, P.O. Box 30121, Seattle, WA (US) 98113-0121

( * ) Notice: Subject to any disclaimer, the term of this patent is extended or adjusted under 35 U.S.C. 154(b) by 0 days.

(21) Appl. No.: 10/928,421

(22) Filed: Aug. 27, 2004

(51) Int. Cl.
*A63F 9/12* (2006.01)

(52) U.S. Cl. ..... 273/156; 273/153 S

(58) Field of Classification Search ..... 273/153 R, 273/157 R, 153 S, 156; 446/112, 115, 116, 446/124, 125, 127
See application file for complete search history.

(56) References Cited

U.S. PATENT DOCUMENTS

| | | | | | |
|---|---|---|---|---|---|
| 319,764 | A * | 6/1885 | Westcott | 446/125 |
| 1,294,446 | A * | 2/1919 | Greenstreet | 446/122 |
| 2,132,757 | A * | 10/1938 | Paulson | 446/124 |
| 2,472,363 | A * | 6/1949 | Blackinton | 446/127 |
| 2,907,137 | A * | 10/1959 | Enrmann | 446/127 |
| 3,547,444 | A * | 12/1970 | Williams et al. | 273/294 |
| 3,924,376 | A * | 12/1975 | Tsurumi | 52/591.1 |
| 5,215,490 | A * | 6/1993 | Szoradi | 446/115 |
| 5,267,863 | A * | 12/1993 | Simmons, Jr. | 434/96 |
| 5,826,873 | A * | 10/1998 | Lavermicocca | 273/157 R |
| 6,241,248 | B1 * | 6/2001 | Winter | 273/153 S |
| D506,790 | S * | 6/2005 | Gee | D21/479 |

* cited by examiner

*Primary Examiner*—Steven Wong
(74) *Attorney, Agent, or Firm*—Mark S Hubert

(57) ABSTRACT

This invention generally relates to a set of parallelepipedal bodies (cells) capable of matingly compatible engagement for interconnection, so as to allow up to three degrees of freedom in the sliding movement of an individual cell or grouping of cells about a grouping of other interconnected cells from the set. Each cell may be monolithic or constructed from six face plates. For cubic and rhombohedral forms, the face plates are designed to interlock in construction with any other face plate to form a cell, regardless of the orientation of the face plates. A first set of cells utilizes a uniform face plate, each cell differing only in the orientation of this uniform face plate about the other uniform face plates on the cell. A second set of cells utilizes two different but matingly compatible face plates. Again, each cell differs only in the orientation of either of the matingly compatible face plates about the other face plates on the cell.

14 Claims, 11 Drawing Sheets

LOC CLASS R-3L

R-3T-0L

LOC CLASS L-3L

L-3T-0L

R-3T-0P

L-3T-0P

R-4T-AL

L-4T-AL

R-4T-AP

L-4T-AP

LOC CLASS R-3L

R-4T-AT

R-4T-0

R-5T

R-6T

LOC CLASS L-3L

L-4T-AT

L-4T-0

L-5T

L-6T

LOC CLASS R-3L

R-2T-AT

R-2T-0

R-3T-AL

R-3T-AW

LOC CLASS L-3L

L-2T-AT

L-2T-0

L-3T-AL

L-3T-AW

LOC CLASS R-3L

R-0T

R-1T

R-2T-AL

R-2T-AP

LOC CLASS L-3L

L-0T

L-1T

L-2T-AL

L-2T-AP

KINEMATICALLY COMPATIBLE PARALLELPIPEDAL CELLS

TECHNICAL FIELD

This invention generally relates to a set of cubic, rhombohedral or generally parallelepiped bodies (cells) capable of matingly compatible interconnection so as to allow up to three degrees of freedom in the movement of each individual cell about an array of other interconnected cells from the set. Although each cell was designed to serve as a housing for an auto replicating machine, this set of cells may also be used as the elemental components in such simple devices as hand puzzles or a child's construction set.

BACKGROUND OF THE INVENTION

The present invention relates to a set of unique parallelepipedal cells, capable of a hollow core construction. Each cell has six faces, that matingly interlock with the faces on the other cells in the set. The cells are free to move about each other individually or in groupings, generally with three degrees of freedom. (I.E. for rectangular parallelepipeds, movement is allowed in each of the X, Y and Z axis.) The cells may be of a monolithic single-piece design or composed of six or less single face plates. There are two different designs of faces that can form the cells. In the first design each face plate is identical. The second design incorporates two different face plates. For the cubic or rhombohedral form each cell face plate is designed to be assembled with any other face plate to form a cell, regardless of the orientation of the face plates. A parallelepiped form with differing edge-lengths would require up to six different types of face plates. When six face plates are assembled they form the hollow core parallelepipedal cell. The tapered interlocking design on the backside of each face plate maximizes the amount of hollow interior space while providing for a rigid unibody design wherein the strength of the cell is a synergistic function of all six face plates. Since the desired end use is as a cellular level, self propelled building block for robotic architecture, the ease of fabrication and degree of miniaturization that can be accomplished with this design is one of this invention's stronger features.

Since the field of art for such an invention is so narrow, there is little in the way of prior art to compare it to. Although some earlier prototypes have been constructed, this set's design greatly simplifies the mass fabrication of the cell set as well as the ease of a cell or cell grouping about another cell or cell grouping.

SUMMARY OF THE INVENTION

In accordance with the invention, an object of the present invention is to provide an improved, enclosed body cell, capable of housing a set of internal components, where each of the cell's six faces can be cheaply and simply fabricated and assembled.

It is another object of this invention to provide a building block cell for use in a self replicating machine that can be easily miniaturized.

It is a further object of this invention to provide a set of enclosed body parallelepipedal cells that is comprised of as few unique cell face plate orientations as possible yet still allowing each cell kinematic compatibility in up to three degrees of freedom.

It is still a further object of this invention to provide for a set of enclosed body parallelepipedal cells that comprises several subsets of the minimum number of unique cells that allow complete kinematic compatibility in three degrees of freedom for every cell in the subset.

It is yet a further object of this invention to provide a set of hollow body parallelepipedal cells where each cell has six identical exterior faces that allow for complementary, mating engagement and up to three degrees of freedom of sliding movement with other similar but unique hollow body parallelepipedal cells.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements. Other objects, features and aspects of the present invention are discussed in greater detail below.

DETAILED DESCRIPTION

Referring to FIGS. 1–4 it can be seen that the present invention, comprises a complete set of unique parallelepipedal cells (cells). Each parallelepipedal cell 2 has six parallelogram faces 4. Each face 4 of a given parallelepipedal cell 2 resides normal to all adjacent faces, thus the parallelepipedal formation. A face 4 has either a symmetrically centered design face (as in the alternate embodiment) or an offset design face (as in the preferred embodiment). Both embodiments utilize a form of "Tee" and "Slot" mating engagement. "Tees" are denoted T and "Slots" are denoted S. For simplicity of explanation and visual clarity, the author has chosen to discuss and illustrate primarily the alternate embodiment cell.

Figure 1:
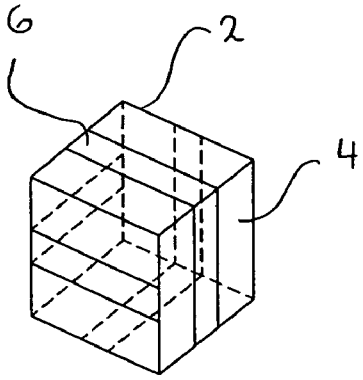
FIG. 1 is a transparent, axonometric, three dimensional view of a unique alternate embodiment cell having slot faces only.
Figure 3:
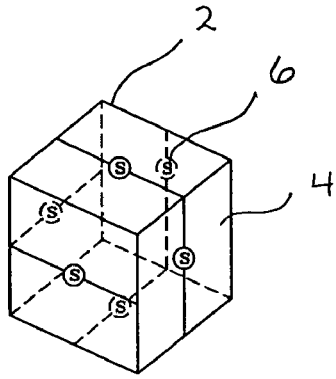
FIG. 3 is a transparent, axonometric, three dimensional view of the same unique alternate embodiment cell of FIG. 1, wherein the face design is alphabetically denoted for simplification purposes.
Figure 2:
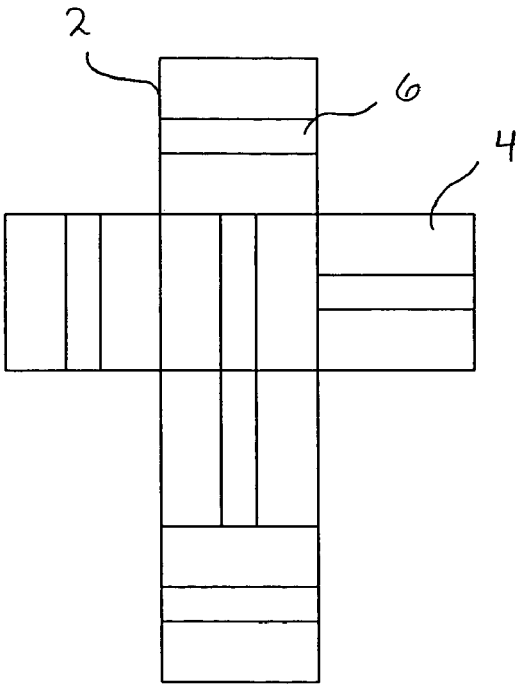
FIG. 2 is a box layout view of the same unique alternate embodiment cell of FIG. 1.
Figure 4:
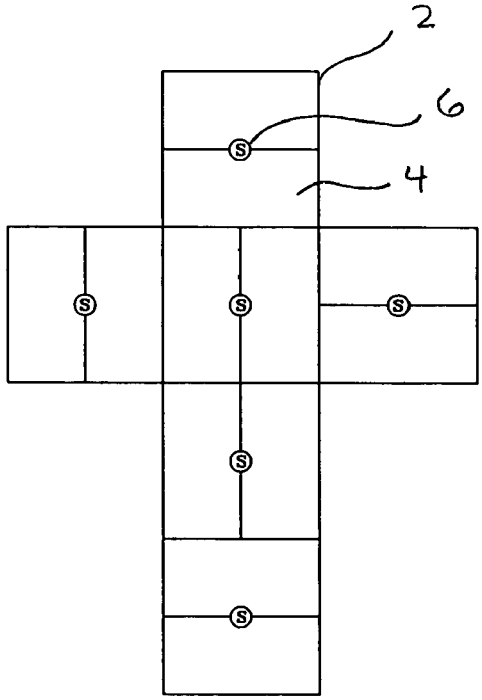
FIG. 4 is a box layout view of the same unique alternate embodiment cell of FIG. 3.
Figure 5A:
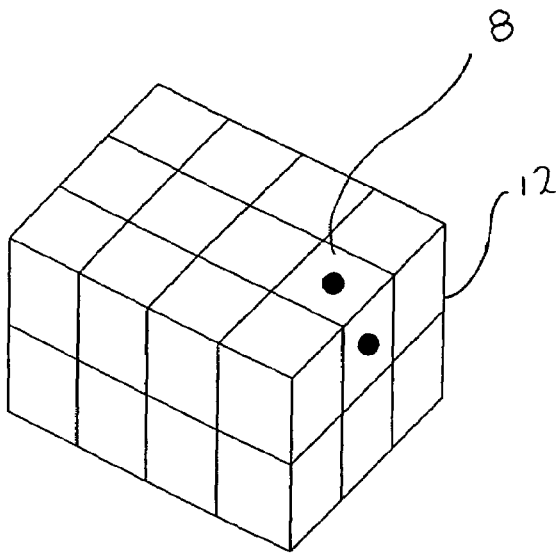
FIGS. 5 A–D depict the movement of a dot identified cell in the X, Y and Z directions.
Figure 5B:
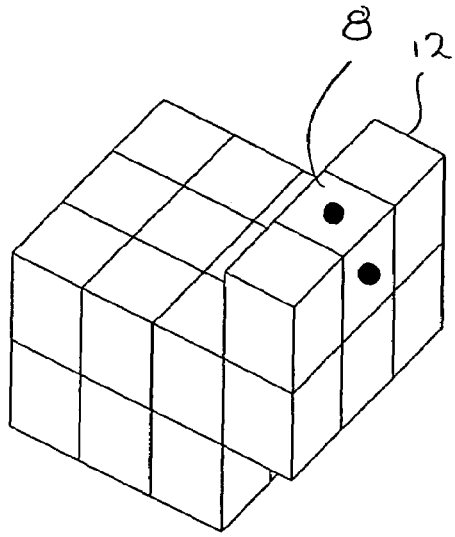
Figure 5C:
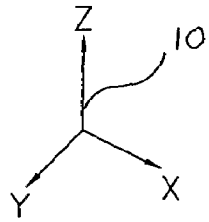
Figure 5C:
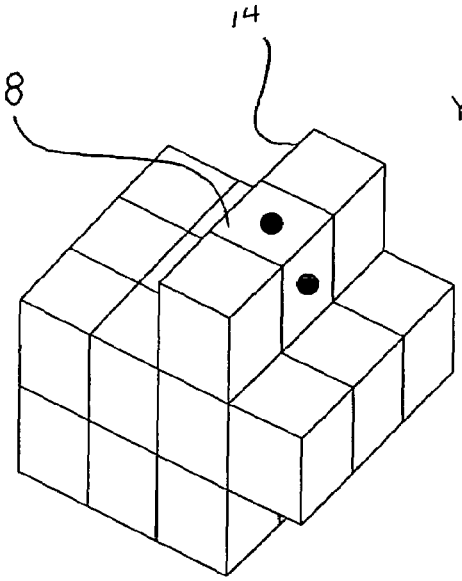
Figure 5D:
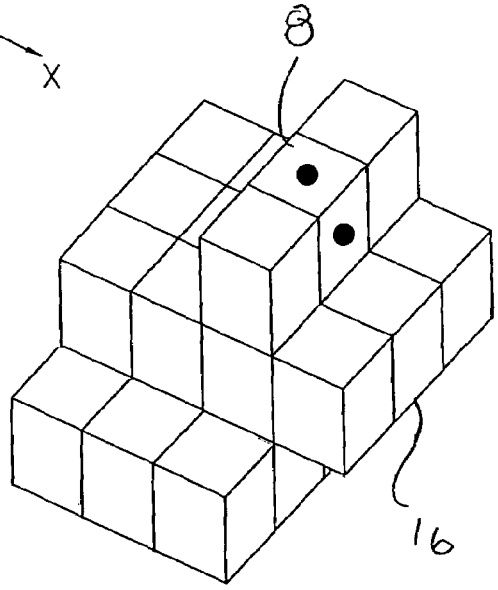

The cell 2 of FIGS. 1–4 is an alternate embodiment cell having six faces 4 each with a "Slot" 6 thereon. FIG. 1 shows a transparent, axonometric view of a three dimensional cell representation. FIG. 2 shows the same cell in a box layout view. FIGS. 3 and 4 illustrate FIGS. 1 and 2 again, using the alphabetic "Slot" designation of S.

This complete set of cells contains several sub sets (arrays) of unique cells that matingly interconnect so as to allow sliding, yet engaged movement without jamming, in three degrees of freedom for any cell in the array about any other cell in the array. FIG. 5 A–D illustrate such movement. In FIG. 5 B dot identified cell 8 and the other cells in the closest YZ plane 12 have moved along the Z axis, (as depicted by plane orientation scale 10) from their position in FIG. 5 A. In FIG. 5 C it can be seen that dot identified cell 8 and the other cells in the upper YX plane 14 have moved along the X axis. Finally, in FIG. 5 D dot identified cell 8 and the other cells in the upper YX plane 14 and middle YX plane 16 have moved along the Y axis. The resultant manipulation of arrayed cells have allowed dot identified cell 8 freedom of movement in the X, Y, and Z planes. Hence three degrees of freedom of movement.

These unique cell arrays adapted for sliding, engaged movement without jamming, in three degrees of freedom are termed "Minimum Kinematically Compatible Arrays" (MKCA). Note that although any cell in the complete set of unique cells may be matingly interconnected with any other unique cell, not all combinations of cells in the complete set can be combined to accomplish kinematic compatibility. The MKCA represent the smallest number of unique cells that will allow the maximum number of degrees of freedom of movement. For lack of confusion as well as replacement, repair, and manufacturing purposes it is desirable to have these MKCA's identified. These MCKA reside within a local orientation class (LOC) of cells based on the commonality of face orientation of the cell. The number of unique cells that can be assembled to form an MKCA within a specific type of LOC differs. Each LOC may require one, two four or eight cells to operate and form a MKCA, depending upon the LOC as well as the specific embodiment (alternate or preferred—as below). In no instances though, does any LOC require more than 8 cells to achieve a minimum kinematic compatibility between cells in that MCKA. Note, that the MKCA's are not achieved from the random selection of any of the cells in the LOC, but rather are comprised of select cells.

Since the faces of neighboring cells must interlock and allow sliding engagement between their faces, there must be complementary design faces. Thus, a symmetrically centered design face necessitates two complementary design faces, whereas an offset design face may be self complementary.

Figure 6A:
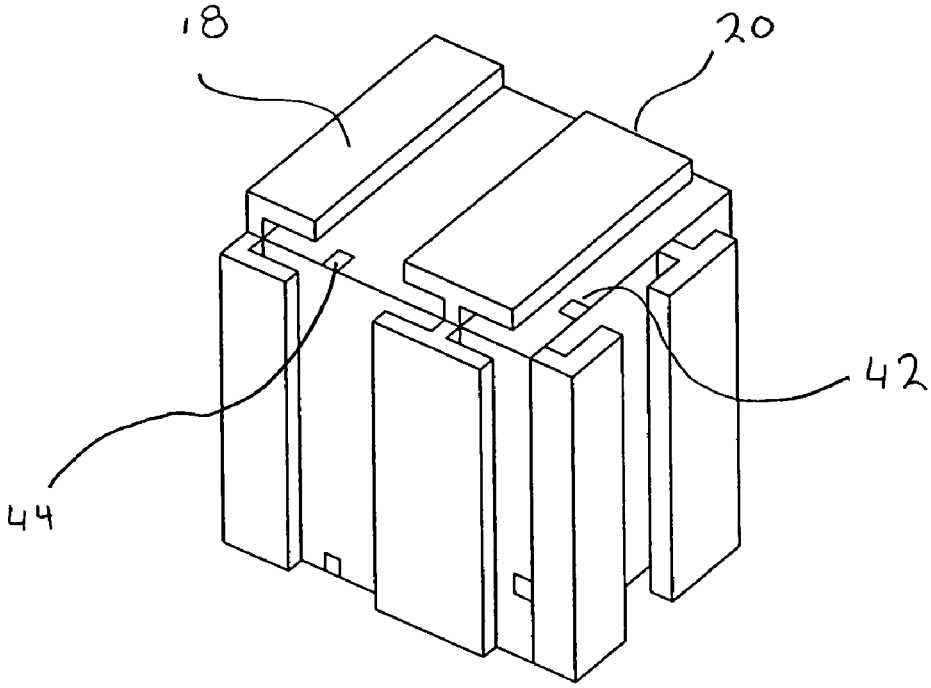
FIGS. 6 A & B show a preferred embodiment cell in assembled face plates or monolithic form.
Figure 6B:
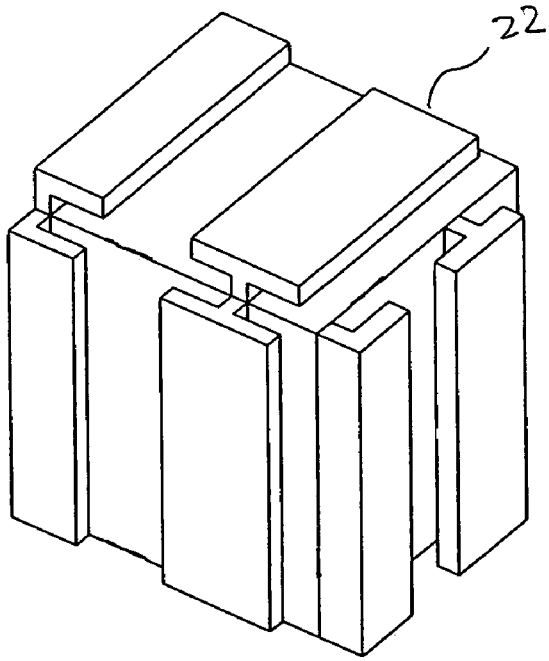
Figure 7:
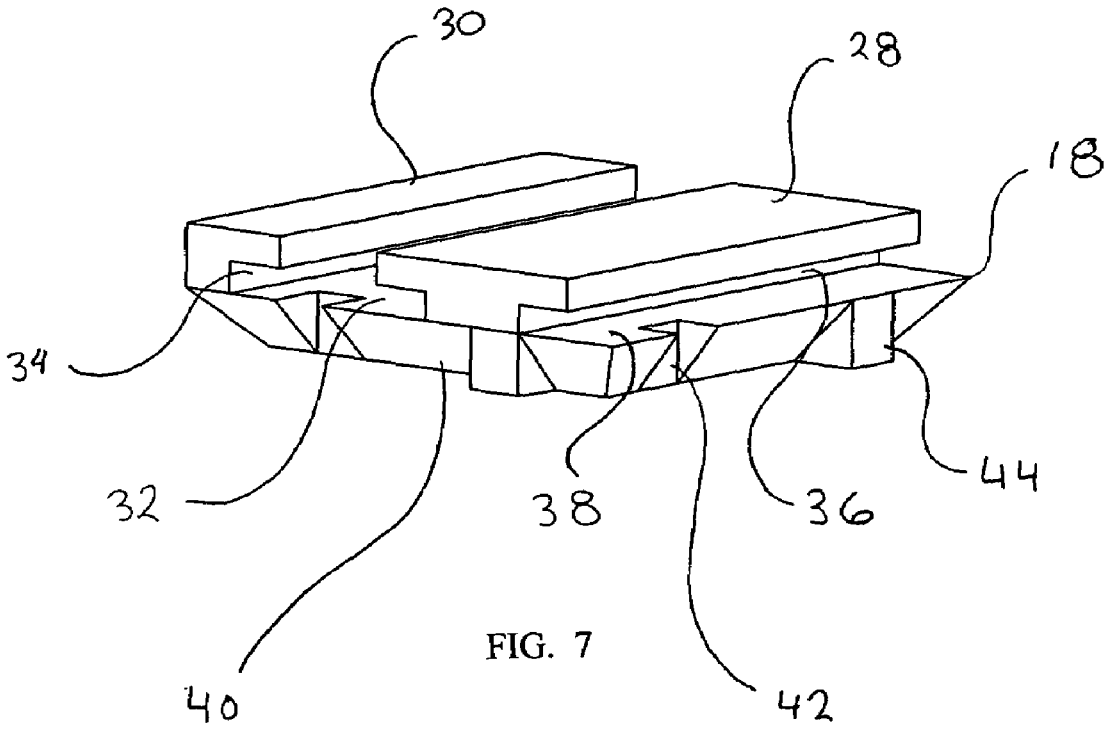
FIG. 7 is a side view of the self complementary offset design face plate used to make up the parallelepipedal cells in the preferred embodiment set of cells.
Figure 8:
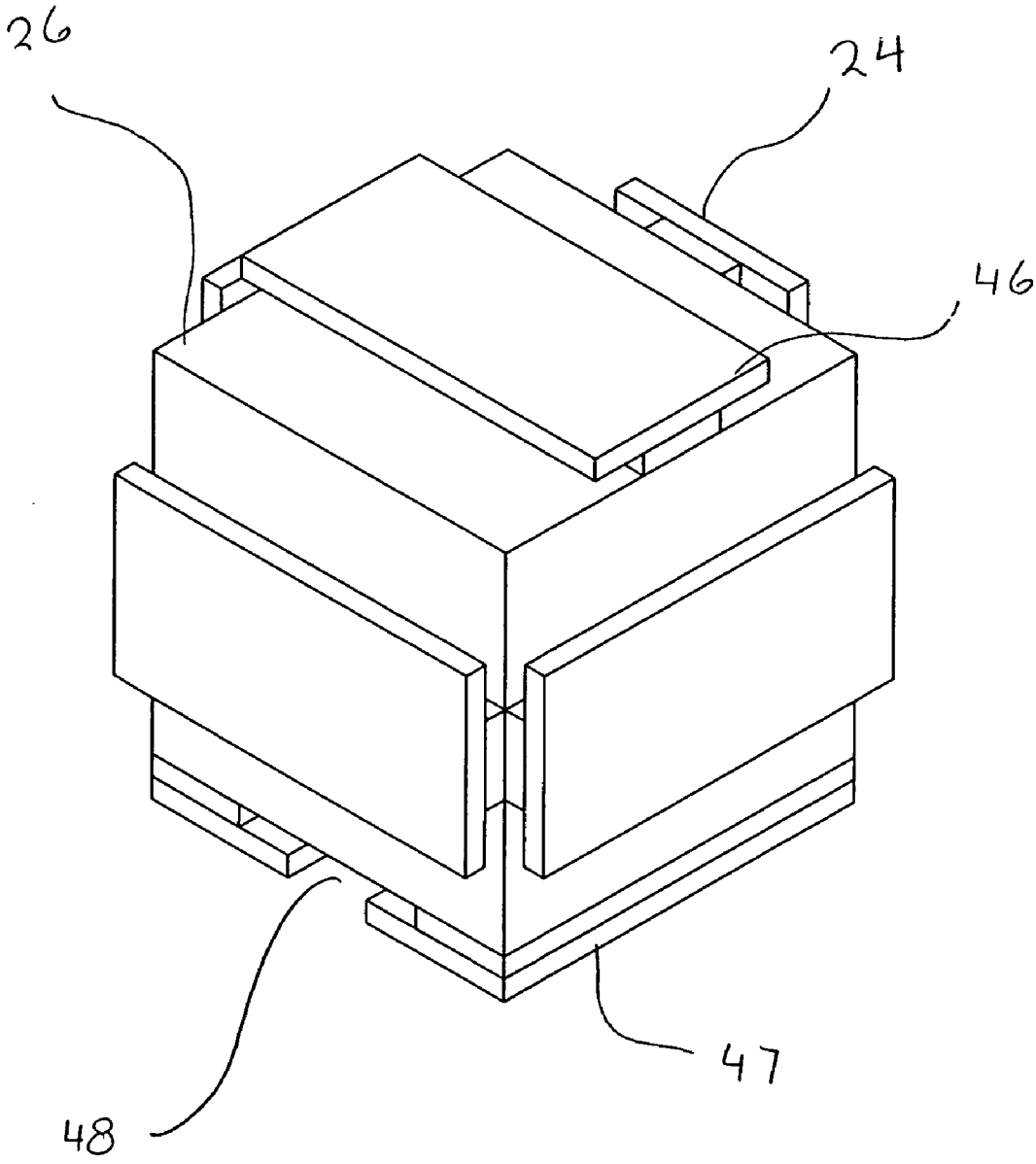
FIG. 8 shows an perspective view of an alternate embodiment cell.
Figure 9:
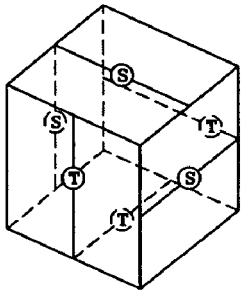
FIGS. 9–12 illustrate in alphabetic designations, all sixteen cells in the alternate embodiment of R-3L Local Orientation Class with the corresponding sixteen mirror image cells in the L-3L Local Orientation Class placed adjacent.
Figure 9:
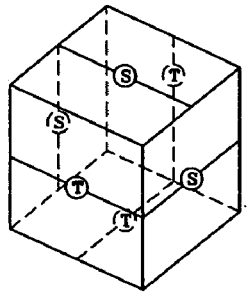
Figure 9:
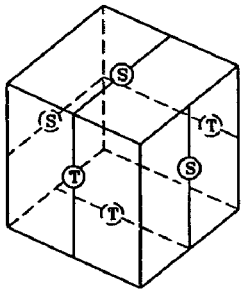
Figure 9:
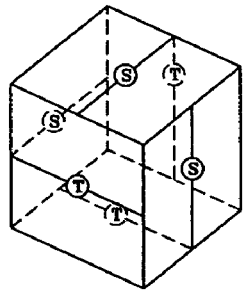
Figure 9:
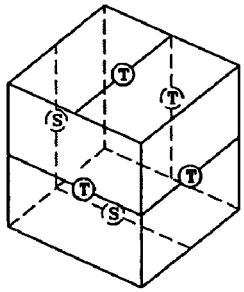
Figure 9:
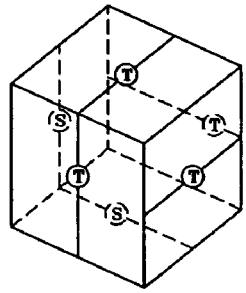
Figure 9:
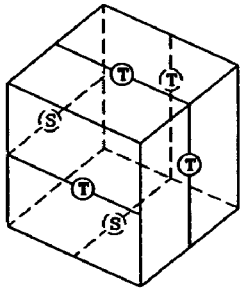
Figure 9:
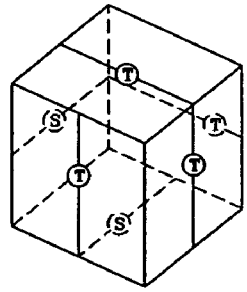
Figure 10:
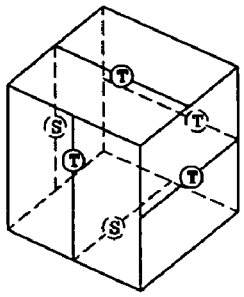
Figure 10:
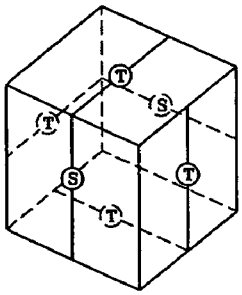
Figure 10:
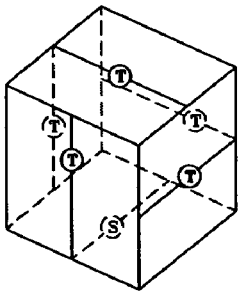
Figure 10:
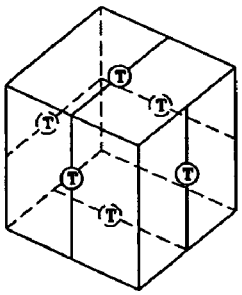
Figure 10:
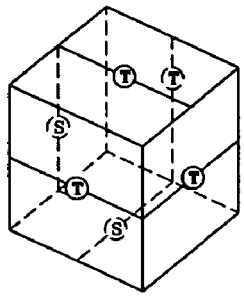
Figure 10:
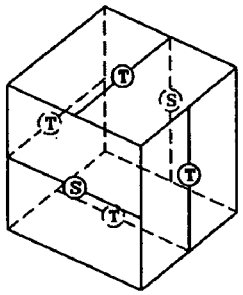
Figure 10:
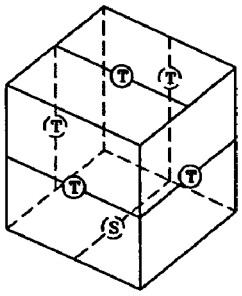
Figure 10:
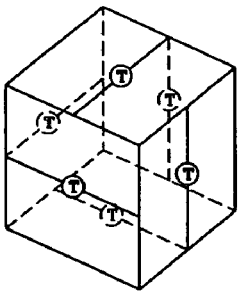
Figure 11:
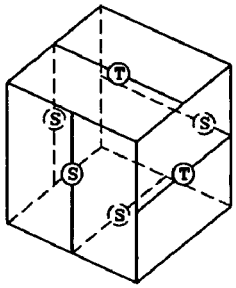
Figure 11:
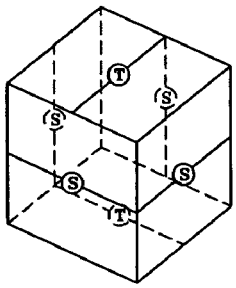
Figure 11:
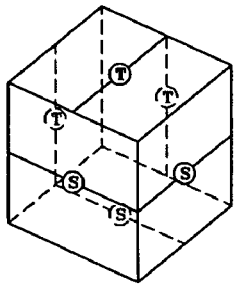
Figure 11:
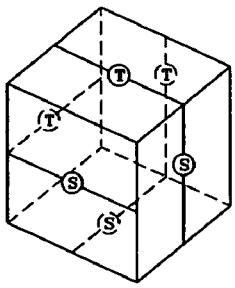
Figure 11:
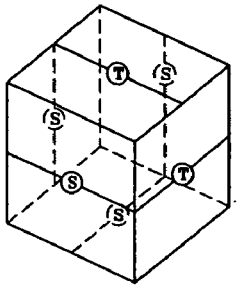
Figure 11:
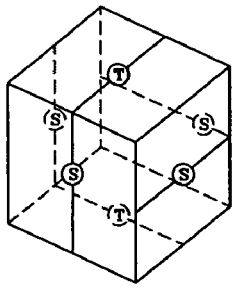
Figure 11:
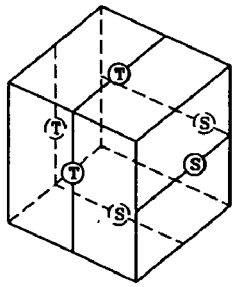
Figure 11:
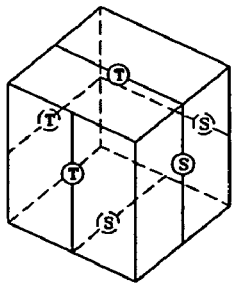
Figure 12:
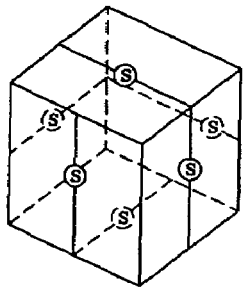
Figure 12:
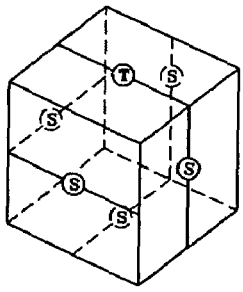
Figure 12:
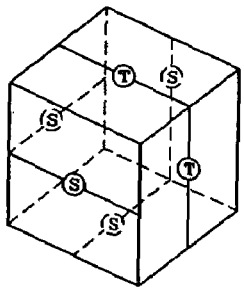
Figure 12:
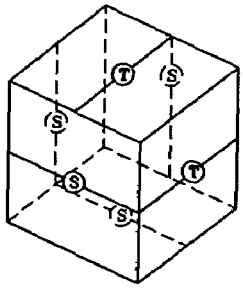
Figure 12:
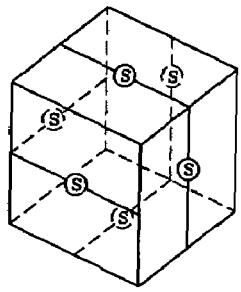
Figure 12:
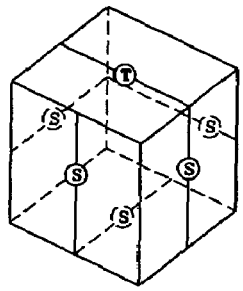
Figure 12:
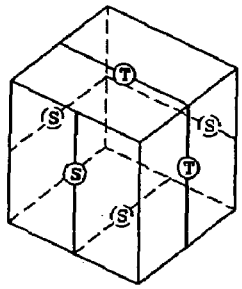
Figure 12:
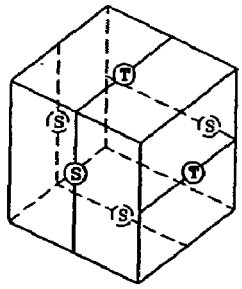

There is a preferred embodiment set of cells and an alternate embodiment set of cells. The preferred embodiment set incorporates cells that utilize a single face having a design that is offset from the face's centerline. FIGS. 6 A and 6 B depict such a face design. FIG. 6 A shows this design on a preferred embodiment cell 20 assembled from six of the identical face plates 18 illustrated in FIG. 7. FIG. 6 B shows this design on a monolithic cell 22 with this design formed on each the cell's six faces.

The alternate embodiment set incorporates cells 24 that utilize two different yet matingly compatible faces having designs that are each centered symmetrically about the centerline of the face 26. The manufacture of cells is simplified with the preferred embodiment face plate assembled cell 20 as each cell face plate 18 is identical and may be assembled to form any of the unique cells.

The off set design face plate 18 of the preferred embodiment 20 can be constructed in many ways. It can have one or more Tee posts 28 and one or more half Tee posts 30 formed upon the top side 32 of the face plate 18 so as to leave an inverted Tee slot 34 between them and an inverted half Tee slot 36 adjacent the Tee post 28. The inverted Tee slot 34 is complementary to the Tee post 28, while the inverted half Tee slot 36 is complementary to the half Tee post 30. When off set design face plates are matingly engaged only sliding movement parallel to the longitudinal axis of the Tees or Slots is allowed. An alternate design for the preferred embodiment (not illustrated) has only one, off set half Tee post, undercut to prevent lateral sliding. The off set, yet complementary design of the preferred embodiment's face plate 18 mechanically enmeshes the cells 20 together thereby allowing potential movement of the cells 20 relative to each other in all three planes regardless of the orientation of the cell mass.

Each preferred embodiment cell's off set design face plate has six sides: a generally planer front 38, a planer back (not illustrated) and four tapered sides 40. Each tapered side 40 has one or more triangular recesses (detents) 42 formed therein and one or more complementary shaped triangular bosses 44 formed thereon. The recesses 42 and bosses 44 are spaced equally from their nearest adjacent sides. Each recess 42 has two adjacent bosses 44 and each boss 44 has two adjacent recesses 42. When any two tapered face plate sides 40 are brought together, their bosses 44 and recesses 42 matingly engage each other such that their fronts 38 lie in normal planes. Once all six face plates 18 have been attached in a similar fashion a cell 20 is complete and the cellular structure gains the three directional strength of all six face plates 18. The attachment of the face plates 18 can be by mechanical means such as pinning, bolting or welding, chemical means such as gluing, or by magnetic attraction.

The symmetrical design faces of the alternate embodiment cell 24 have either one or more Tee Posts 46 formed upon the Tee post face 26 or one or more inverted Tee Slots 48 formed upon the Tee slot face 47. Both the inverted Tee Slots 48 or Tee Posts 46 are symmetrically aligned along the longitudinal axis of their respective faces 26 and 47. The inverted Tee Slots 48 are complementary to the Tee posts 46. These complementary designs of the alternate embodiment's faces mechanically enmeshes the cells together thereby allowing movement of the cells relative to each other in all three planes regardless of the orientation of the cell mass.

Although not shown, the assembly of alternate embodiment cells 24 may be accomplished using six face plates bearing the symmetrical design faces of the alternate embodiment cell 24 in a similar fashion to that used in the preferred embodiment cell 20.

The number of cells in the alternate embodiment set or preferred embodiment set is a function of the face design and face orientation. In the alternate embodiment cells 24 there are two different faces (those bearing Tee Posts 46, and those bearing Tee Slots 48), but only two different ways of orientating each face. There are thus only 8 different cell orientations with respect to the local orientation of the sliding axis of the faces on the cells in this set, but when both of the two different faces are interchanged in all possible configurations onto these 8 cells there is a set of a maximum of 224 unique cells. In the preferred embodiment cell 20 although there is only one offset design face plate 18, because this face plate 18 can be oriented in 4 different directions there are substantially less than 224 unique cells in a complete set. In arriving at the MKCAs, the face design combinations of all of the cells in that MKCA have a specific commonality in their visual representation. This commonality of face orientation within a MKCA is called the local orientation class. (LOC) There are several MKCA's associated with each LOC. Each LOC is named for what it visually represents.

Each face of a cell, regardless of the type of cell, offers one degree of freedom however, a cell only has a maximum of three degrees of freedom. Certain LOC's only allow for two degrees of freedom.

Referring to FIGS. 9–14 alphabetic designations and perspective views of all sixteen cells in the alternate embodiment of R-3L and L-3L Local Orientation Classes, the following is best understood.

The orientation of the faces/face plates, regardless of whether they belong to a preferred embodiment cell 20 or an alternate embodiment cell 24, fall into only eight different 3D patterns (LOCs) named by their visual appearance. Regardless of the face/face plate design, each face/face plate has a Slot or Tee or Slot/Tee that runs parallel to two of the opposing edges of the face/face plate and perpendicular to the other two opposing edges. This visually represents a line running across the face/face plate. When the visual line is continuous on two faces/face plates it looks like an "L". (Refer to any cell of FIGS. 9–14.) When the visual line is continuous on three faces/face plates it looks like a "U". (When the visual line is continuous on four faces/face plates it looks like a "O". When the line is not continuous beyond one face/face plate it looks like an "I". Thus, a cell with a continuous visual line on three faces/face plates, one continuous line on two faces/face plates and one line on the remaining face/face plate has a naming convention of IUL. Similarly, a cell with two sets of continuous visual lines on each of three faces/face plates would have a naming convention of 2U. In the case of the IOI cell there are two types. Those with their I's parallel to each other (IOI) and those with their I's perpendicular to each other. (IO-I) In the special case of cells with 3L's they are divided up into mirror images of each other, (chiral pairs) thus the Right®) and Left (L) designations. No other LOC's have mirror images other than the 3L LOC. That is to say the mirror image of any other LOC in the complete set of LOC's is itself—meaning that the mirror image of any LOC cell can be rotated manually to get back to the original LOC cell. This is similar to the dextro and levto designations of mirror image in the field of chemistry. When a LOC-cell type is decorated with the Tees and Slots, it may or may not generate chiral pairs, depending on which faces have which types of Tees and Slots. This is one of the reasons there are differing numbers of cells within each LOC in both embodiments. The other reason for different numbers of cells is due to the rotational symmetries of the various LOCs and of the distribution of Tees and Slots on the faces of the cells of each particular LOC.

The tables below list the naming conventions and the properties of the cells in that LOC for the preferred and alternate embodiments. This naming convention, based on a string of alphabet letters is entirely in line with the naming conventions commonly utilized in geometry and mathematical tiling applications. FIGS. 9–12 illustrate in symbolic drawings, the sixteen cells in the R3L LOC with the corresponding sixteen mirror image cells in the L3L LOC placed adjacent.

Figure 13:
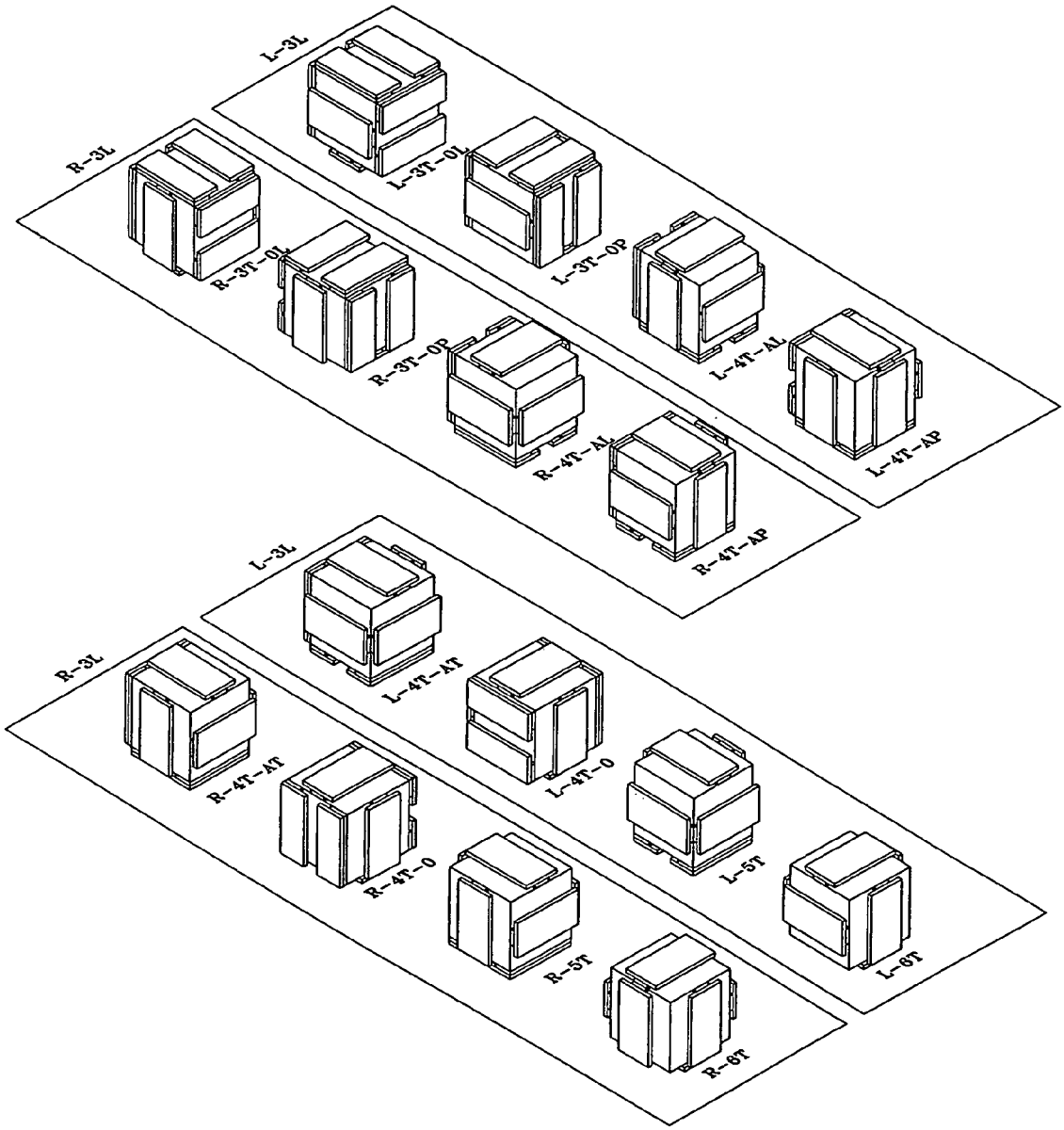
FIGS. 13 & 14 illustrate in perspective views all of the unique cells that comprise the R-3L and L-3L Local Orientation Classes of cells belonging to the alternate embodiment.
Figure 14:
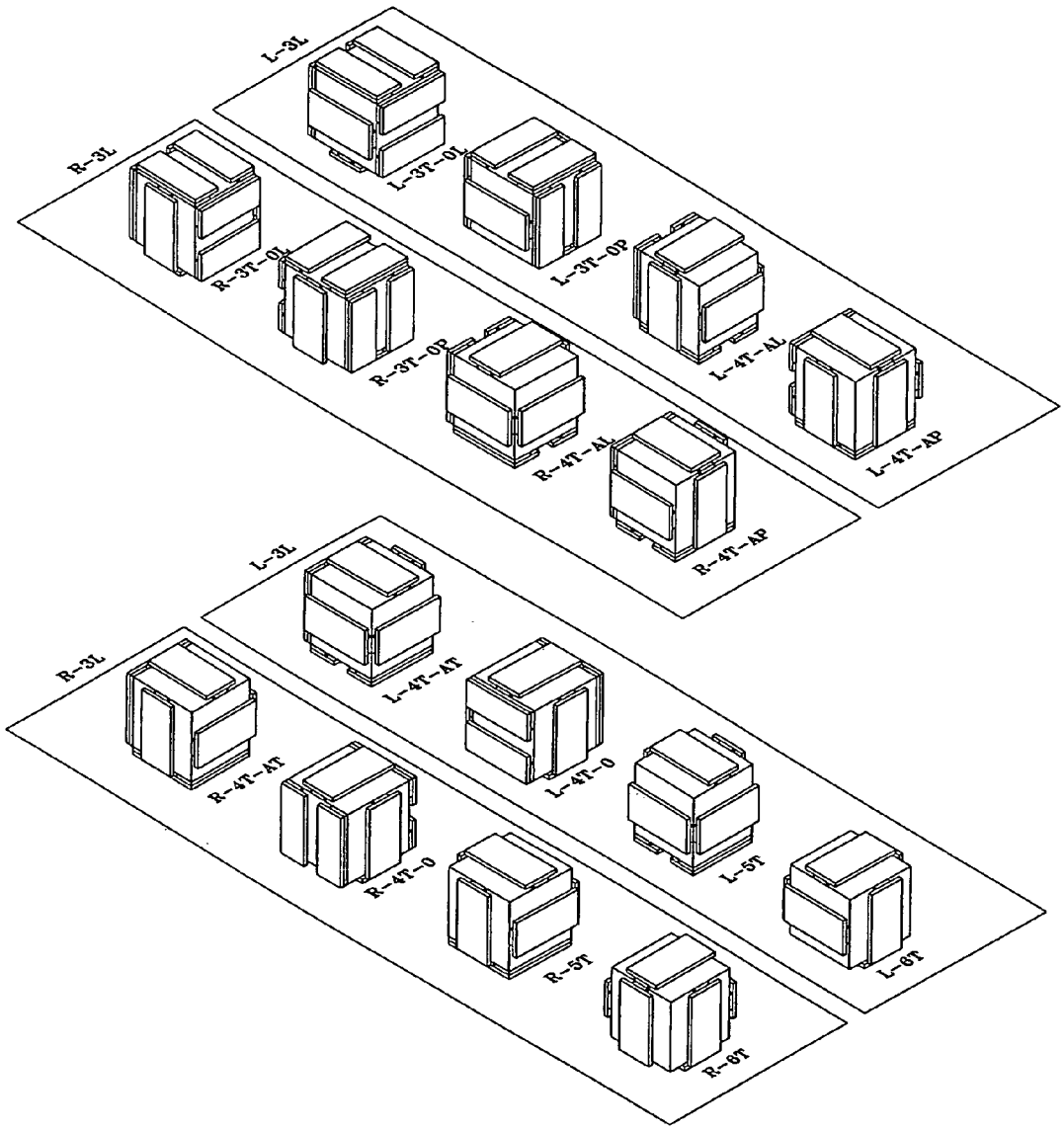

The FIGS. 13 and 14 show the same R3L and L3L LOC's except depicted in an actual perspective view.

The naming designations for the alternate embodiment cells within each LOC is a three component system as follows:

First component is R or L depending upon which mirror image it is. This is only used in the R3L and L3L LOC's. It is eliminated in all other LOC's.

Second component refers to the number of "Tee" type faces or "Slot" type faces on the cell and ranges from one to six.

Third component refers to the visual arrangement of the "Tee" type faces or "Slot" type faces on the cell with respect to each other. They can be on adjacent faces that share a common edge (denoted by "A") or they can be on parallel/opposite faces (denoted by "O"). The L, T, or P designations are used only in the case of Tee" type faces or "Slot" type faces on adjacent faces that share a common edge of the cell. It relates to the visually representation created by the longitudinal center line of the "T" or "S" running across the cell. The L denotes that the visual representation forms an "L". The P denotes that the visual representation of the center lines are parallel. The T denotes that the visual representation of the center lines are perpendicular but do not intersect.

Although there are eight different LOC's there are only seven different kinds of MKCAs. This is due to the fact that the L-3L and R-3L LOCs must be combined to make a kinematically compatible operating array.

The degrees of freedom (DOF) of any cell is a function of the degrees of freedom (or absence thereof) in which each of the cells in a specific LOC can move. The specific characteristics of the cells in a LOC may allow each cell to move up to 4 different ways in each of the three planes. (X, Y and Z planes). For a cell to have three degrees of freedom it must be able to move at least one way in each of the planes. Not all LOC's have three DOF. The IOI and IO-I LOC's only have two degrees of freedom, however in the X direction the IOI LOC cells are capable of sliding movement in four different ways in the X plane, and the IO-I LOC cells are capable of sliding movement in three different ways in the X plane. No cell is capable of more than six ways of movement. These different properties of allowable movement are important in the applications of robotic architecture. Depending upon the ultimate function of the robotic structure, movement in four directions in one plane may be much more important than movement in two directions in all three planes. The following tables illustrate the DOF for the various LOC's in the X, Y and Z planes as well as for the entire cell.

The Preferred Embodiment Cell

Offset Design Face

In the preferred embodiment cell 20 there is only one face plate 18 that is capable of being orientated in any of four ways. It has an offset design "Slot/Tee" face plate 18.

Preferred Embodiment Cell Set

| LOC Name | # OF UNIQUE CELLS | Characteristics (Generation Rules) | Degrees of Freedom (DOF) |
|---|---|---|---|
| 6I | 8 | 1) Parallel faces have parallel DOF orientations<br>2) Perpendicular faces have perpendicular DOF orientations. | 3 |
| IOI | 14 | 1) all parallel faces have parallel DOF orientations.<br>2) 4 faces have globally parallel local orientations. | 2 |

-continued

Preferred Embodiment Cell Set

| LOC Name | # OF UNIQUE CELLS | Characteristics (Generation Rules) | Degrees of Freedom (DOF) |
|---|---|---|---|
| IO-I | 14 | 1) 2 sets of parallel faces have parallel DOF orientations.<br>2) The 2 sets of parallel DOF lines are co-planar<br>3) Remaining 2 faces have perpendicular DOF orientations. | 2 |
| 2U | | 1) 2 sets of parallel faces each have parallel DOF.<br>2) The 2 sets have globally parallel local DOF orientations.<br>3) Remaining 2 faces have perpendicular DOF orientations. | 3 |
| U3I | | 1) 2 sets of parallel faces each have parallel DOF.<br>2) The 2 sets of parallel DOF faces have mutually perpendicular DOF.<br>3) Remaining 2 faces have perpendicular DOF orientations. | 3 |
| IUL | | 1) One set of parallel faces has parallel DOF orientations.<br>2) Two sets of parallel faces have perpendicular local orientations. | 3 |
| R-3L | | 1) Parallel faces have perpendicular local orientations.<br>2) 3 "L" intersections are mirror images of the "R" intersections | 3 |
| L-3L | | 1) Parallel faces have perpendicular local orientations.<br>2) 3 "R" intersections are mirror images of the "L" intersections | 3 |

Preferred Embodiment Cell Set & Alternate Embodiment Cell Set

| LOC | Degrees of Freedom (DOF) | | | Cell Degrees of Freedom |
|---|---|---|---|---|
| Name | X | Y | Z | (DOF) |
| 6I | 2 | 2 | 2 | 3 |
| IOI | 4 | 2 | 0 | 2 |
| IO-I | 3 | 3 | 0 | 2 |
| 2U | 4 | 1 | 1 | 3 |
| U3I | 3 | 2 | 1 | 3 |
| IUL | 3 | 2 | 1 | 3 |
| R-3L | 2 | 2 | 2 | 3 |
| L-3L | 2 | 2 | 2 | 3 |

Alternate Embodiment

Centered Design Face

In the alternate embodiment cell 24 there are two different faces whose design is symmetrical about the centerline of the face. These are called the "Tee" face 26 and the "Slot" face 47. Due to their symmetrical design there are only two different ways of orientating each face.

Alternate Embodiment Cell Set

| LOC Name | # OF UNIQUE CELLS | Characteristics (Generation Rules) | Degrees of Freedom (DOF) |
|---|---|---|---|
| 6I | 12 | 1) Parallel faces have parallel DOF orientations.<br>2) Perpendicular faces have perpendicular DOF orientations. | 3 |
| IOI | 28 | 1) Parallel faces have parallel DOF orientations.<br>2) 4 faces have globally parallel local DOF orientations. | 2 |
| IO-I | 24 | 1) 2 sets of parallel faces each have parallel DOF.<br>2) The 2 sets of parallel DOF are co-planar.<br>3) Remaining 2 faces have perpendicular DOF orientations. | 2 |
| 2U | 24 | 1) 2 sets of parallel faces have parallel DOF<br>2) The 2 sets of parallel DOF lines are co-planar.<br>3) Remaining 2 faces have perpendicular DOF orientations. | 3 |
| U3I | 40 | 1) 2 sets of parallel faces each have parallel DOF.<br>2) The 2 sets of parallel DOF faces have mutually perpendicular DOF.<br>3) Remaining 2 faces have perpendicular DOF orientations. | 3 |
| IUL | 64 | 1) One set of parallel faces have parallel DOF orientations.<br>2) Two sets of parallel faces have perpendicular local orientations | 3 |
| R-3L | 16 | 1) Parallel faces have perpendicular local orientations.<br>2) 3 "L" intersections are mirror images of the "R" intersections | 3 |
| L-3L | 16 | 1) Parallel faces have perpendicular local orientations.<br>2) 3 "R" intersections are mirror images of the "L" intersections | 3 |

Alternate Embodiment Cell Set

| LOC Name | # of Different MKCA's | # of Unique Cells per each MKCA |
|---|---|---|
| 6I | 5 | 1, 1, 2, 4 & 8 |
| IOI | 9 | 1, 1, 2, 2, 2, 4, 4, 4, & 8 |
| IO-I | 8 | 2, 2, 2, 2, 4, 4, 8 & 8 |
| 2U | 7 | 2, 2, 2, 4, 4, 4, & 8 |
| U3I | 10 | 2, 2, 2, 2, 4, 4, 4, 4, 8 & 8 |
| IUL | 12 | 4, 4, 4, 4, 4, 4, 8, 4, 4, 8, 8, & 8 |
| R-3L | 5 | 8, 8, 8, 8, & 8 |
| L-3L | 5 | 8, 8, 8, 8, & 8 |

The above description will enable any person skilled in the art to make and use this invention. It also sets forth the best modes for carrying out this invention. There are numerous variations and modifications thereof that will also remain readily apparent to others skilled in the art, now that the general principles of the present invention have been disclosed.

Although the intended use of the preferred and alternate embodiment cells is for the building block components of a self-replicating machine, these cell sets are also intended for manual manipulation as would be in a thinking man's puzzle. The internal drive mechanisms and logic control systems for use of the above described cells in a self replicating machine have not been discussed. That is beyond the scope of this patent.

Throughout this set of specification and drawings, the alternate embodiment has been used mainly for illustration and reference purposes. This was purposely done because visual representations of the various machinations of the preferred embodiment, hampered by the limitations of two dimensional axonometric drawings, require numerous lines that causes extreme visual confusion.

What is claimed is:

1. A parallelogram plate adapted for assembly with five substantially similar other parallelogram plates into a parallelepipedal formation comprising:

a generally planar top surface;

a generally planer bottom surface;

four generally planar side surfaces tapered toward said plate's bottom surface such that said bottom surface is smaller in area than said top surface, and wherein said top surface and said side surfaces meet at four linear top edges and said bottom surface and said side surfaces meet at four linear bottom side edges, and wherein said four side surfaces are generally identical and each side surface has at least one recess formed in the configuration of a right prism therein and at least one matingly conformed protrusion, wherein said top surface has a "Tee" (T) shaped post traversing the length of said top surface and residing parallel to, but offset from, a longitudinal axis of said top surface, and a ½ "Tee" (½ T) shaped post residing parallel to said "Tee" (T) shaped post and adjacent to a top edge such that a complementary inverted "Tee" (T) shaped slot is formed therebetween said posts and a complementary inverted ½ "Tee" (½ T) shaped opening is formed adjacent to said "Tee"(T) shaped post.

2. A set of cells further comprising:

at least one cell; wherein said cell has six parallelogram surfaces having at least one post and complementary slot formed thereon and adapted for mating engagement and sliding motion with respect to a substantially similar face, and wherein each said face is a substantially similar face plate and wherein said set is comprised of eight dimensionally substantially similar cells, wherein each cell's face plates are orientated upon said cell so that each cell is unique from each other cell in the set.

3. The set of cells of claim 2 wherein said face plates are adapted for assembly with five substantially similar other face plates into a parallelepipedal formation, and said face plates comprise:

a generally planar top;

a generally planer bottom;

four generally planar sides tapered toward said plate's bottom such that said bottom is smaller in area than said top, and wherein said top and said sides meet at four linear top edges and said bottom and said sides meet at four linear bottom side edges.

4. The set of cells of claim 3 wherein said four side surfaces are generally identical and each side surface has at least one recess formed therein and at least one matingly conformed protrusion formed thereon.

5. The set of cells of claim 4 wherein said protrusion forms a prism.

6. A set of unique cells comprising at least one cell wherein said cell has six parallelogram planar surfaces bearing:

any orientation of a face plate that has a generally planar top surface;

a generally planer bottom surface;

four generally identical, planar side surfaces having at least one prism shaped recess formed therein and at least one matingly conformed protrusion formed thereon, and wherein said four side surfaces are tapered toward said plate's bottom surface such that said bottom surface is smaller in area than said top surface, and wherein said top surface and said side surfaces meet at four linear top edges and said bottom surface and said side surfaces meet at four linear bottom side edges, and wherein said top surface has a "Tee" (T) shaped post traversing the length of said top surface and residing parallel to, but offset from, a longitudinal axis of said top surface, and a ½ "Tee" (½ T) shaped post residing parallel to said "Tee" (T) shaped post and adjacent to a top edge such that a complementary inverted "Tee" (T) shaped slot is formed therebetween said posts and a complementary inverted ½ "Tee" (½ T) shaped opening is formed adjacent to said "Tee" (T) shaped post.

7. A set of identically geometrically shaped cells comprising at least one cell, wherein said cell has six parallelogram surfaces made of any grouping and any orientation of a first face having at least one post formed thereon and second face having at least one slot formed therein that is complementary in shape to said post and wherein said first face and said second face are adapted for mating engagement and sliding motion relative to each other so that each cell is unique from each other cell in the set.

8. The set of cells of claim 7 wherein said first face and said second face respectively reside upon a planar first face plate and second face plate.

9. The set of cells of claim 8 wherein said first face plate has at least one post formed thereon and said second face plate has at least one slot formed therein.

10. The set of cells of claim 9 wherein said post on said first face plate resides parallel and centered about a longitudinal axis of said first face plate, and said slot on said second face plate resides parallel and centered about a longitudinal axis of said second face plate.

11. The set of cells of claim 10 wherein said first face plate and said second face plates comprise:

a generally planar top surface;

a generally planer bottom surface;

four generally planar side surfaces tapered toward said first and said second plate's bottom surface such that said bottom surface is smaller in area than said top surface, and wherein said top surface and said side surfaces meet at four linear top edges and said bottom surface and said side surfaces meet at four linear bottom side edges.

12. The parallelogram plate of claim 11 wherein said four side surfaces on said first and said second face plates are generally identical and each side surface has at least one recess formed therein and at least one matingly conformed protrusion formed thereon.

13. The parallelogram plate of claim 12 wherein said protrusions on said first and said second face plates form a prism.

14. The set of cells of claim 13 wherein the number of posts on said first face plate is one and the number of said slots on said second face plate is one, and further wherein said post has a "Tee" (T) configuration and said slot has an inverted "Tee" (T) configuration.

* * * * *